US005207201A

United States Patent [19]

Schlagmüller et al.

[11] Patent Number: 5,207,201

[45] Date of Patent: May 4, 1993

[54] FUEL DISTRIBUTION INJECTION PUMP FOR INTERNAL COMBUSTION ENGINES

[75] Inventors: Walter Schlagmüller, Schwieberdingen; Helmut Rembold, Stuttgart; Gottlob Haag, Markgröningen, all of Fed. Rep. of Germany

[73] Assignee: Robert Bosch GmbH, Stuttgart, Fed. Rep. of Germany

[21] Appl. No.: 836,262

[22] PCT Filed: Jul. 26, 1990

[86] PCT No.: PCT/DE90/00576

§ 371 Date: Feb. 28, 1992

§ 102(e) Date: Feb. 28, 1992

[87] PCT Pub. No.: WO91/03639

PCT Pub. Date: Mar. 21, 1991

[30] Foreign Application Priority Data

Aug. 30, 1989 [DE] Fed. Rep. of Germany ..... 3928612

[51] Int. Cl.[5] ..... F02M 39/00

[52] U.S. Cl. ..... 123/447; 417/372; 123/449

[58] Field of Search ..... 123/447, 449, 495, 503; 417/372

[56] References Cited

U.S. PATENT DOCUMENTS

| | | | |
|---|---|---|---|
| 4,385,610 | 5/1983 | LeBlanc | 123/447 |
| 4,412,519 | 11/1983 | Hoch et al. | 123/449 |
| 4,469,069 | 9/1984 | Kuroyanagi et al. | 123/447 |
| 4,485,789 | 12/1984 | Walter et al. | 123/447 |
| 4,554,903 | 11/1985 | Straubel et al. | 123/447 |
| 4,697,565 | 10/1987 | Kobayashi et al. | 123/449 |
| 4,730,585 | 3/1988 | Abe et al. | 123/447 |
| 4,840,162 | 6/1989 | Brunel | 123/447 |
| 4,940,037 | 7/1990 | Eckert | 123/447 |
| 4,976,236 | 12/1990 | Brunel | 123/447 |
| 5,000,668 | 3/1991 | Nakamura et al. | 123/449 |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel injection pump of a distributor type for internal combustion engines including, a pump plunger guided within a pump cylinder, which forms a pump chamber and which is driven to perform reciprocating and rotating motion by a driving gear which is submerged in a lubricating oil bath. The pump plunger has a distribution hole which is in contact with the pump chamber and which sequentially links this chamber, during the compression stroke of the pump plunger, to injection jets. The fuel filling of the pump chamber takes place via a magnetically operated valve, which is open during the intake stroke and closed during the compression stroke of the pump plunger. For an enlargement of the filling cross-section during the intake stroke without an enlargement of the opening of the magnetically operated valve, a relief hole in the pump plunger is used which serves a force balancing during the compression stroke and which during the intake stroke links up with a filling hole which is connected with a membrane reservoir.

22 Claims, 1 Drawing Sheet

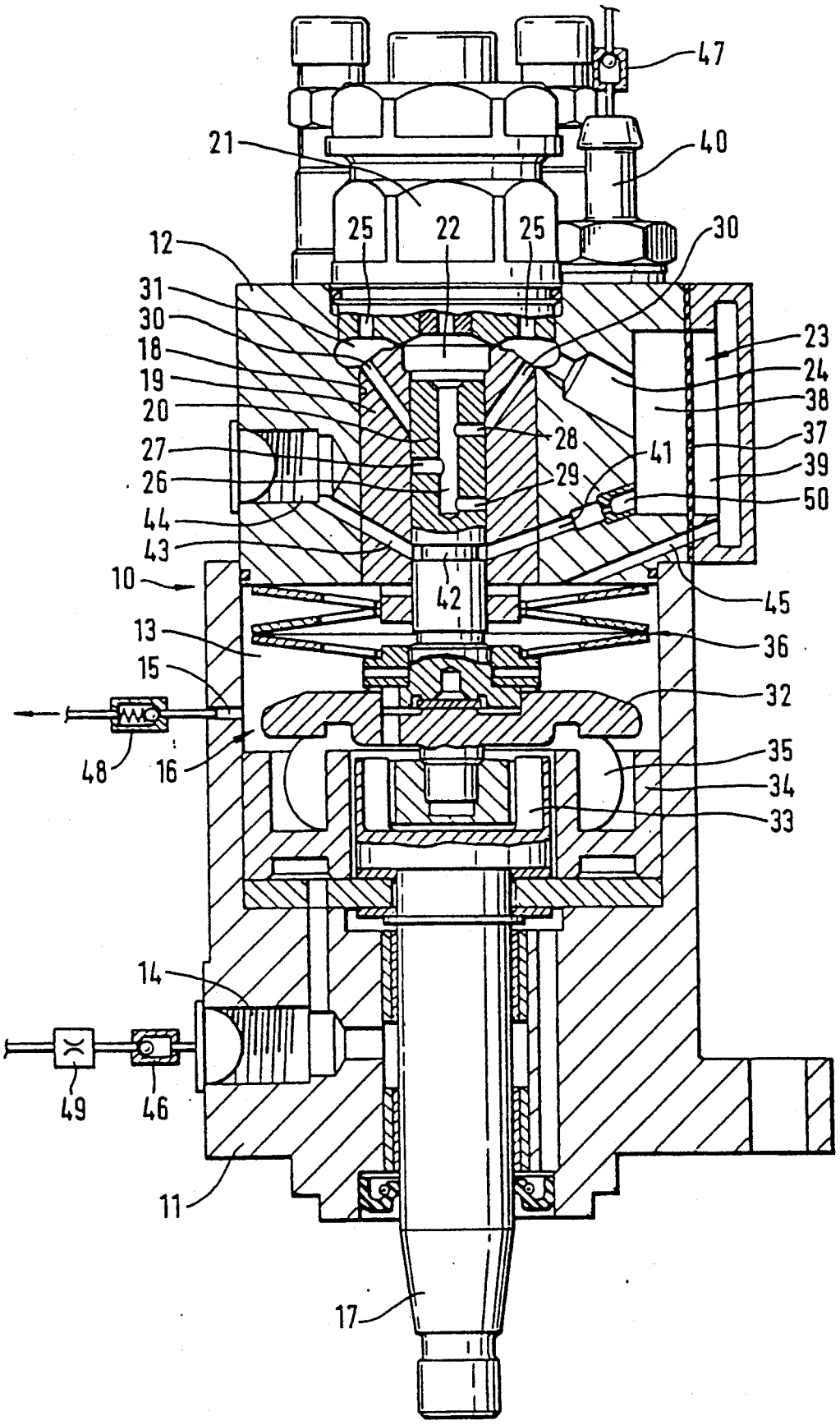
47
40
21
25
22
25
30
12
31
30
18
19
20
27
26
44
43
10
13
15
48
16
14
49
46
11
17
23
24
38
37
39
50
28
41
29
42
45
36
32
35
34
33

FUEL DISTRIBUTION INJECTION PUMP FOR INTERNAL COMBUSTION ENGINES

STATE OF TECHNOLOGY

The invention is based on a fuel distribution injection pump for internal combustion engines as defined hereinafter.

In a known fuel injection pump of this distributor type (DE 36 05 452 A1), a magnetically operated valve is so designed that it closes when energizing current is applied, and it opens when the energizing current is removed. During the intake stroke of the pump plunger, the magnetically operated valve remains unenergized so that fuel can be drawn into the pump chamber from the fuel feed, by the pump plunger. As soon as the magnetically operated valve is energized, it closes, and the intake process is completed. This is followed by the start of the compression or pressure stroke of the pump plunger, in which the fuel present in the pump chamber is pressurized. The pressurized fuel passes through an axial hole and a distribution hole into one of the distribution channels in the pump cylinder, from where the fuel to be injected into one of the cylinders is delivered into the connected injection valve. The fuel injection is completed as soon as the energization of the magnetically operated valve is removed. The magnetically operated valve opens, and any fuel still present in the pump chamber is pushed out via the magnetically operated valve into the fuel infeed. The process of opening and closing the magnetically operated valve thus controls the amount of fuel supplied for injection. The problem involved is that of dimensioning the cross-section of flow for the fuel in the magnetically operated valve. To ensure good filling of the pump chamber, the cross-section should be as large as possible, albeit that a large cross-section of flow necessitates longer switching times and a higher current consumption of the magnetically operated valve.

ADVANTAGES OF THE INVENTION

In contrast, the fuel distribution injection pump of the present invention has the advantage that with good filling of the pump chamber, the cross-section of flow of the magnetically operated valve can be kept small, thus allowing for short duration switching and low current consumption of the magnetically operated valve. According to the invention, this is achieved by virtue of the fact that during the intake stroke of the pump plunger, an additional filling of the pump chamber takes place via the filling and relief holes, by-passing the magnetically operated valve. The relief hole has thus a dual function, first—as already described in the DE 24 49 332 C2—to compensate the lateral forces during the pressure stroke of the pump plunger, which act on the pump plunger via the distribution hole, and further, as an additional filling aid during the intake stroke of the pump plunger. In addition, the use of the relief hole for filling the pump chamber has the advantage that no additional dead volume arises in the filling region, which is particularly important when petrol is used as the fuel, because of its low compression module. The diaphragm reservoir then prevents temporary pressure drops during the intake stroke of the pump plunger, so that an exactly reproducible filling of the pump chamber is ensured with every intake stroke.

The measures listed herein enable advantageous developments and improvements of the fuel distribution injection pump set forth herein.

According to an advantageous embodiment of the invention, the filling holes in the pump cylinder are arranged obliquely, i.e. angled acutely, relative to the cylinder axis. This results in an elliptical terminating area of the filling holes, at the transition from the pump cylinder to the pump plunger, which is of advantage for reasons of the cross-section, since the pump plunger during its revolution also performs an axial movement. If in accordance with another embodiment of the invention, the membrane reservoir is connected via a restrictor to a pressureless fuel return, then a certain amount of fuel will be constantly flowing off. The membranae reservoir is thus constantly flushed, and additionally, heat is dissipated, which promotes the accuracy and reliability of the fuel filling of the pump chamber during the intake stroke.

According to another embodiment of the invention, the pump plunger carries an annular leakage oil groove on the plunger section, close to the driving gear area within the pump cylinder which, on the one hand, is connected to the membrane reservoir and, on the other hand, to the fuel return flow. In this way, any minor oil leakage from the driving gear area into the annular gap between pump plunger and pump cylinder is drained away.

In a preferred embodiment of the invention, the lubricant feed of the driving gear area and the fuel feed each have a non-return valve arranged within them, and in the lubricant drain of the driving gear area, a pressure limiter is arranged and, additionally, the delivery area is connected with a pressure chamber which is separated in the membrane reservoir by the membrane with the face of the membrane directed away from the fuel reservoir area. This design arrangement ensures that the pressure surge which occurs during the intake stroke of the pump plunger and the associated deeper immersion of the pump plunger into the driving gear area due to the volume displacement of the lubricant, is utilized to support the filling of the pump chamber. This pressure surge acts via the membrane of the membrane reservoir, on the fuel reservoir where it temporarily increases the fuel pressure during the intake stroke. The result is an improved filling of the pump chamber.

To ensure a reliable function of the pressure support during the filling of the pump chamber, the lubricant pressure in the driving gear area, in accordance with a further embodiment of the invention, is set approximately equal to the fuel pressure in the fuel storage area of the membrane reservoir. A higher lubricant pressure would preload the membrane in the wrong direction and severely impair the intended effect. For the purpose of setting the pressure, the lubricant drain is provided with a pressure limiting valve. A limitation of the lubricant flow is achieved by a restrictor in the lubricant feed.

BRIEF DESCRIPTION OF THE DRAWING

The invention is explained in more detail by means of an embodiment example shown in the drawing and in the description which follows. The drawing shows a longitudinal section of a fuel injection pump of the distribution type.

DESCRIPTION OF THE EMBODIMENT EXAMPLE

The fuel distribution injection pump for an internal combustion engine shown in longitudinal section in the drawing has a two-part pump housing 10 which comprises a basic body 11 with a hollow cylindrical recess and a pump body 12 positioned on the front face of the basic body, this pump body sealing the hollow cylindrical recess liquid-tight. The hollow cylindrical recess forms a lubricant-filled driving gear area 13, which is connected to a lubricating oil circuit via a lubricating oil feed 14 and a lubricating oil drain 15. The driving gear area 13 has a driving gear 16 arranged within it, which is driven by a drive shaft 17 supported in the basic body 11.

In a coaxial straight-through hole 18 in the pump body 12, a pump cylinder 19 is inserted, in which a pump plunger 20 is axially displaceable. Together with a valve member and a valve seat, not seen here, of an electromagnetic on-off valve 21, the pump plunger 20 forms a pump chamber 22. The on-off valve 21, which is configured as a 2-way valve, controls a link between the pump chamber 22 and a membrane reservoir 23. Of this link, the oblique hole 24 and the two axial holes 25 are visible. The pump plunger 20 has an axial blind hole 26, which terminates in the pump chamber 22. From the blind hole 26, a radial distribution hole 27 and two radial relief holes 28,29, which are spaced apart and arranged symmetrically to the distribution hole 27, all of which lead to the outer surface of the pump plunger. The relief holes 28,29 are arranged diametrically opposite the distribution hole 27, i.e. off set by 180°, in the pump plunger 20. During a rotation of the pump plunger 20, the distribution hole 27 lines up with a number of distribution channels, not seen here, in the pump cylinder 19. The number of distribution channels, which are off-set by the same relative angle in the pump cylinder 19, corresponds to the number of cylinders in the engine. Every distribution channel is connected with an injection jet which is allocated to a particular cylinder of the engine. During the rotation of the pump plunger 20, the relief hole 28 links up with a number of filling holes 30, which are offset from one another by equal angles in the pump cylinder 19. The filling holes 30 which extend obliquely at an acute angle relative to the pump plunger axis, are linked to an annular channel 31, which is connected to the oblique channel 24 which leads to the membrane reservoir 23. The number of filling holes 30 corresponds to the number of distribution channels, with the filling holes 30 being arranged in such a way that a link between the relief hole 28 with one of the filling holes 30 exists whenever the distribution hole 27 does not line up with one of the distribution channels.

The pump plunger 20 is driven in a rotating and simultaneous axially reciprocating movement by the driving gear 16, for which purpose the pump plunger 20 projects with its free end, which faces away from the pump area 22, into the driving gear area 13, and there it is torsionally rigidly connected with the cam 32. The cam 32 is connected axially movable to the drive shaft 17 via a claw coupling 33. A roller holder 34 is torsionally rigidly arranged around the claw coupling 33 in an annular configuration. The roller holder 34 carries a multitude of rollers 35 which are in contact with a cam surface formed on the front face of the cam 32. The cam 32 is pressed in axial direction onto the rollers 35 by means of a disk spring 36, which is supported on the pump body. When the drive shaft 17 turns, the rotational movement is transmitted to the pump plunger 20 via the claw coupling 33 and the cam 32. At the same time, the pump plunger 20 is set into a reciprocating motion via the cam 32 and the rollers 35.

The membrane reservoir 23 has a membrane 37 which separates a fuel reservoir 38 from a pressure chamber 39. The fuel reservoir 38, which is connected with the fuel feed 40, has the oblique channel 24 of the link between the pump chamber 22 and the membrane reservoir 23 terminating in it. In addition, the fuel reservoir 38 is connected to a leakage oil groove 42 on the pump plunger 20 via a connecting hole 41 which penetrates the pump body 12 and the pump cylinder 19. A restrictor 50 is arranged in the connecting hole 41. The leakage oil groove 42 is configured as an annular groove on the plunger section close to the drive gear area 13. The leakage oil groove 42 is in contact with a fuel return 44 via a further connecting hole 43 which penetrates the pump cylinder 19 and the pump body 12. The pressure chamber 39 of the membrane reservoir 23 can be linked with the ambient air, or—as shown in the drawing—connected to the driving gear area 13 via a lubricant hole 45 which extends in the pump body 19. In the latter case, a non-return valve 46 and 47, respectively, is arranged both on the lubricant feed 14 and on the fuel feed 40, and the lubricant drain 15 is provided with a pressure limiter 48. The pressure limiter 48 is used to set the pressure level in the driving gear area 13 to approximately the same pressure level prevailing in the fuel reservoir 38. A restriction of the lubricating oil flow is achieved by means of a restrictor 49 in the lubricant feed 14.

The mode of operation of the described fuel injection pump is as follows:

The pump plunger 20 is set into rotating and reciprocating motion by the drive shaft 17 and cam 32. In this action, the pump plunger 20 performs an intake stroke during which it enlarges the volume of the pump chamber 22, as it moves and penetrates deeper into the driving gear area 13, while it reduces the volume of the pump chamber 22 during its compression or pressure stroke, as it moves upwards, that is when it again moves out of the driving gear area 13. During the intake stroke, the on/off valve is open, allowing fuel from the fuel reservoir 38 of the membrane reservoir 23 to enter via the open connection 24,25 into the pump chamber 22. During this intake stroke, the relief hole 28 is also connected with one of the filling holes 30, allowing fuel also to pass from the fuel reservoir area 28 of the membrane reservoir 23 via the relief hole 38 and the axial blind hole 26 into the pump chamber 22. With a relatively small opening of the on/off valve 21, an overall large filling cross-section is produced via the second filling route for the pump chamber 22, which results in a speedy and reliable fuel filling of the pump chamber 22. The valve opening of the on/off valve 21, required to be only small, enables very short switching times of the on/off valve 21. At the end of the intake stroke, the on/off valve closes upon energization. During the intake stroke, the pump plunger 20 has rotated to such an extent that at the end of the intake stroke, the connection between the relief hole 28 and the filling hole 30 is interrupted. The pump plunger 20 now starts ascending, with the result that the distribution hole 27 links up with a distribution channel which leads to an injection valve. The fuel, which is pressurized by injection pressure and which is present in the pump chamber 22, is delivered via the axial blind hole 26 and the distribution hole 27 to the associated injection valve where it is injected into the cylinder's combustion chamber. The pressure acting radially on the pump plunger 20 via the distribution hole 27 is matched by an equal pressure which acts radially on the pump plunger 20 via the relief holes 28,29. During the compression stroke of the pump plunger 20, a force balance in a radial direction is thus produced, so that the pump plunger 20 moves concentrically within the pump cylinder 19, and jamming of the plunger, such as can be observed on pump plungers 20 without relief holes 28,29, is avoided. During the compression stroke of the pump plunger 20, the relief holes 28,29 are closed by the internal wall of the pump cylinder 19 and have no linkage to the filling holes 30. On de-energization of the electromagnetic on/off valve 21, the valve opens and the fuel injection is completed. The fuel which is still present in the pump chamber 22 is pushed out by the pump plunger 20 into the membrane reservoir 23. The membrane reservoir 23 is used to prevent temporary pressure drops during the intake stroke which may occur due to the large filling volume flowing off into the pump chamber 22. If—as shown in the drawing—the pressure chamber 39 of the membrane reservoir 23 is connected with the driving gear area 13, then the membrane reservoir 23 can be additionally used for an improved filling of the pump chamber 22.

During the intake stroke, the pump plunger 20 penetrates deeper into the driving gear area 13 and causes a volume displacement of the lubricating oil. The pressure surge which occurs in the driving gear area 13 acts on the membrane 37 in the pressure chamber 39 of the membrane reservoir 23 and causes a temporary pressure increase in the fuel reservoir area 38. This pressure increase achieves an improvement and acceleration in filling the pump chamber 22 with fuel. The optimum effect is achieved when the lubricating oil pressure in the driving gear area 13 is approximately equal to the fuel pressure normally prevailing in the fuel reservoir 38 of the membrane reservoir 23. If the lubricating oil pressure is too high, then the membrane 37 is preloaded in the wrong direction, and the effect of the pump plunger 20 immersing in the lubricating oil volume is significantly reduced.

By connecting the fuel reservoir 38 of the membrane reservoir 23 to the fuel return 44, the fuel reservoir 38 will be flushed and additionally, heat will be dissipated. The fuel is thus essentially kept at a constant temperature level, which increases the reliability and the reproducibility of the fuel filling of the pump chamber 22. Restriction of the fuel discharge is achieved by means of the restrictor 50.

The invention is not limited to the described embodiment example of a fuel injection pump. For example, for the additional fuel filling of the pump chamber 22, it is possible while by-passing the electromagnetic on/off valve 21, to use not only the relief hole 28, but additionally the relief hole 29. The filling holes 30 would then require to be appropriately designed.

The foregoing relates to a preferred exemplary embodiment of the invention, it being understood that other variants and embodiments thereof are possible within the spirit and scope of the invention, the latter being defined by the appended claims.

We claim:

1. A fuel distribution injection pump for internal combustion engines comprising a pump plunger guided within a pump cylinder with one end projecting into a driving gear area which is filled with lubricant via a lubricant infeed and drain; a driving gear arranged in said driving gear area, which converts a rotation of a drive shaft into a reciprocating and simultaneous rotational movement of the pump plunger; a pump chamber formed by said pump plunger and said pump cylinder, a distribution hole arranged radially in the pump plunger, said distribution hole is linked to the pump chamber via an axial hole in the pump plunger and which, during a compression stroke of the pump plunger and as a consequence of a rotational motion of the pump plunger, said distribution hole links up with distribution channels in the pump cylinder, one channel at a time, which lead to injection valves; a magnetically operated valve which is linked to a fuel feed line and to the pump chamber, for a control of a fuel injection quantity as delivered by the pump plunger to the injection valves, a fuel reservoir 38, limited by a membrane 37, of a membrane reservoir (23) is arranged in a fuel flow link (24, 25) between the magnetically operated valve (21) and the fuel feed line (40); at least one relief hole (28) is provided within the pump plunger (20) diametrically thereof, the distribution hole (27) terminates in the axial hole (26) and during rotation of the pump plunger (20) links up with filling holes (30) in the pump cylinder (19), and the filling holes (30) are linked to the fuel reservoir (38) of the membrane reservoir (23) and are arranged within the pump cylinder (19) in such a way that a link to the relief hole (28) is established during every intake stroke of the pump plunger (20) and is interrupted during the compression stroke thereof.

2. An injection pump in accordance with claim 1, in which the filling holes (30) extend at an acute angle relative to the cylinder axis of the pump cylinder (19).

3. An injection pump in accordance with claim 1, in which the fuel reservoir (38) of the membrane reservoir (23) is connected to a fuel return (44) via a restrictor (50).

4. An injection pump in accordance with claim 2, in which the fuel reservoir (38) of the membrane reservoir (23) is connected to a fuel return (44) via a restrictor (50).

5. An injection pump in accordance with claim 3, in which the pump plunger (20) carries an annular oil leakage (42) on its plunger section close to the driving gear area (13) within the pump cylinder (19) and a first connection hole (41) linked to the fuel reservoir (38) of the membrane reservoir (23) and a second connection hole (43) linked to the fuel return (44) terminate in the inner jacket of the pump cylinder (19) in a vicinity of the oil leakage groove (42).

6. An injection pump in accordance with claim 4, in which the pump plunger (20) carries an annular oil leakage (42) on its plunger section close to the driving gear area (13) within the pump cylinder (19) and a first connection hole (41) linked to the fuel reservoir (38) of the membrane reservoir (23) and a second connection hole (43) linked to the fuel return (44), terminate in the inner jacket of the pump cylinder (19) in a vicinity of the oil leakage groove (42).

7. A fuel injection pump in accordance with claim 1, in which a non-return valve (46) is arranged in a lubricant feed (14) of the driving gear area (13) and in the fuel feed line (40), and a pressure limiter (48) is arranged in a lubricant drain (15) of the driving gear area (13) and the driving gear area (13) is connected to a pressure chamber (29) which is formed in the membrane reservoir (23) by the membrane (37) with its surface facing away from the fuel reservoir (38).

8. A fuel injection pump in accordance with claim 2, in which a non-return valve (46) is arranged in a lubricant feed (14) of the driving gear area (13) and in the fuel feed line (40), and a pressure limiter (48) is arranged in a lubricant drain (15) of the driving gear area (13) and the driving gear area (13) is connected to a pressure chamber (29) which is formed in the membrane reservoir (23) by the membrane (37) with its surface facing away from the fuel reservoir (38).

9. A fuel injection pump in accordance with claim 3, in which a non-return valve (46) is arranged in a lubricant feed (14) of the driving gear area (13) and in the fuel feed line (40), and a pressure limiter (48) is arranged in a lubricant drain (15) of the driving gear area (13) and the driving gear area (13) is connected to a pressure chamber (29) which is formed in the membrane reservoir (23) by the membrane (37) with its surface facing away from the fuel reservoir (38).

10. A fuel injection pump in accordance with claim 5, in which a non-return valve (46) is arranged in a lubricant feed (14) of the driving gear area (13) and in the fuel feed line (40), and a pressure limiter (48) is arranged in a lubricant drain (15) of the driving gear area (13) and the driving gear area (13) is connected to a pressure chamber (29) which is formed in the membrane reservoir (23) by the membrane (37) with its surface facing away from the fuel reservoir (38).

11. An injection pump in accordance with claim 7, in which the lubricant pressure in the driving gear area (13) is set to approximately the same pressure level as the fuel pressure in the fuel reservoir (38) of the membrane reservoir (23).

12. An injection pump in accordance with claim 8, in which the lubricant pressure in the driving gear area (13) is set to approximately the same pressure level as the fuel pressure in the fuel reservoir (38) of the membrane reservoir (23).

13. An injection pump in accordance with claim 9, in which the lubricant pressure in the driving gear area (13) is set to approximately the same pressure level as the fuel pressure in the fuel reservoir (38) of the membrane reservoir (23).

14. An injection pump in accordance with claim 10, in which the lubricant pressure in the driving gear area (13) is set to approximately the same pressure level as the fuel pressure in the fuel reservoir (38) of the membrane reservoir (23).

15. An injection pump in accordance with claim 7, in which a restrictor (49) is arranged in the lubricant feed (14).

16. An injection pump in accordance with claim 8, in which a restrictor (49) is arranged in the lubricant feed (14).

17. An injection pump in accordance with claim 9, in which a restrictor (49) is arranged in the lubricant feed (14).

18. An injection pump in accordance with claim 10, in which a restrictor (49) is arranged in the lubricant feed (14).

19. An injection pump in accordance with claim 11, in which a restrictor (49) is arranged in the lubricant feed (14).

20. An injection pump in accordance with claim 12, in which a restrictor (49) is arranged in the lubricant feed (14).

21. An injection pump in accordance with claim 13, in which a restrictor (49) is arranged in the lubricant feed (14).

22. An injection pump in accordance with claim 14, in which a restrictor (49) is arranged in the lubricant feed (14).

* * * * *